US011834259B2

(12) United States Patent
Dougherty

(10) Patent No.: US 11,834,259 B2
(45) Date of Patent: Dec. 5, 2023

(54) FEMININE PRODUCT DISPOSAL ASSEMBLY

(71) Applicant: Kevin Dougherty, Boerne, TX (US)

(72) Inventor: Kevin Dougherty, Boerne, TX (US)

( * ) Notice: Subject to any disclaimer, the term of this patent is extended or adjusted under 35 U.S.C. 154(b) by 467 days.

(21) Appl. No.: 17/176,278

(22) Filed: Feb. 16, 2021

(65) Prior Publication Data

US 2022/0258963 A1 Aug. 18, 2022

(51) Int. Cl.

| | |
|---|---|
| ***B65F 1/00*** | (2006.01) |
| ***B65F 1/10*** | (2006.01) |
| ***B65F 1/14*** | (2006.01) |
| ***B65F 1/16*** | (2006.01) |

(52) U.S. Cl.

CPC ..... *B65F 1/002* (2013.01); *B65F 1/10* (2013.01); *B65F 1/1421* (2013.01); *B65F 1/1442* (2013.01); *B65F 2001/1676* (2013.01)

(58) Field of Classification Search

CPC ..... B65F 1/002; B65F 1/10; B65F 1/1421; B65F 1/1442; B65F 2001/1672

See application file for complete search history.

(56) References Cited

U.S. PATENT DOCUMENTS

| | | | | |
|---|---|---|---|---|
| 4,592,192 | A | 6/1986 | Jacob | |
| 4,869,049 | A * | 9/1989 | Richards | B65B 9/15 53/469 |
| 5,027,578 | A | 7/1991 | Natterer | |
| 6,141,945 | A | 11/2000 | Becher | |
| 6,722,107 | B2 * | 4/2004 | Morand | B65F 1/062 53/567 |
| D545,521 | S | 6/2007 | Titas | |
| 8,245,864 | B2 * | 8/2012 | Garland | B65F 1/1415 220/252 |
| 8,973,774 | B1 * | 3/2015 | Stravitz | B65F 1/0026 220/908 |
| 9,248,481 | B1 * | 2/2016 | Soto | A61L 9/205 |
| 9,592,956 | B2 * | 3/2017 | Garland | B65F 1/1615 |
| 2007/0089688 | A1 | 4/2007 | Nitzsche | |
| 2010/0133271 | A1 * | 6/2010 | Garland | B65F 1/10 220/254.1 |
| 2016/0167872 | A1 * | 6/2016 | Dunn | B65F 1/062 220/495.07 |

FOREIGN PATENT DOCUMENTS

| | | | | |
|---|---|---|---|---|
| EP | 893368 | A1 * | 1/1999 | B65F 1/10 |
| EP | 1433723 | A1 * | 6/2004 | B65F 1/10 |
| FR | 2962990 | A1 * | 1/2012 | B65F 1/10 |
| KR | 101167027 | B1 * | 7/2012 | B65F 1/10 |

* cited by examiner

*Primary Examiner* — Timothy L Maust

(57) ABSTRACT

A feminine product disposal assembly includes a drum that has a rotatable section for opening and closing the drum. A hatch is positioned within the drum, a garbage bag is positionable on the hatch and the garbage bag drops downwardly in the drum when the hatch is opened. A closure unit is positioned in the drum and the closure unit closes the garbage bag when the closure unit is turned on to enclose the used feminine product in the garbage bag for disposal. The closure unit is disengaged from the garbage bag when the closure unit is turned off to facilitate the garbage bag to receive the used feminine hygiene product.

14 Claims, 5 Drawing Sheets

FEMININE PRODUCT DISPOSAL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to disposal devices and more particularly pertains to a new disposal device for sealing used feminine products in a garbage bag for disposal.

(2) Description of Related Art Including Information Disclosed Under 37 CFR 1.97 and 1.98

The prior art relates to disposal devices including a waste material bagging device that includes a vacuum sealing mechanism and a heat sealing mechanism. The prior art discloses a garbage can that vacuum seals garbage bags contained therein. The prior art discloses a recycling machine that separates recyclable materials and subsequently bags the material in a bar coded bag. The prior art also discloses a variety of garbage processing devices that vacuum seal garbage in a garbage bag.

BRIEF SUMMARY OF THE INVENTION

An embodiment of the disclosure meets the needs presented above by generally comprising a drum that has a rotatable section for opening and closing the drum. A hatch is positioned within the drum, a garbage bag is positionable on the hatch and the garbage bag drops downwardly in the drum when the hatch is opened. A closure unit is positioned in the drum and the closure unit closes the garbage bag when the closure unit is turned on to enclose the used feminine product in the garbage bag for disposal. The closure unit is disengaged from the garbage bag when the closure unit is turned off to facilitate the garbage bag to receive the used feminine hygiene product.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
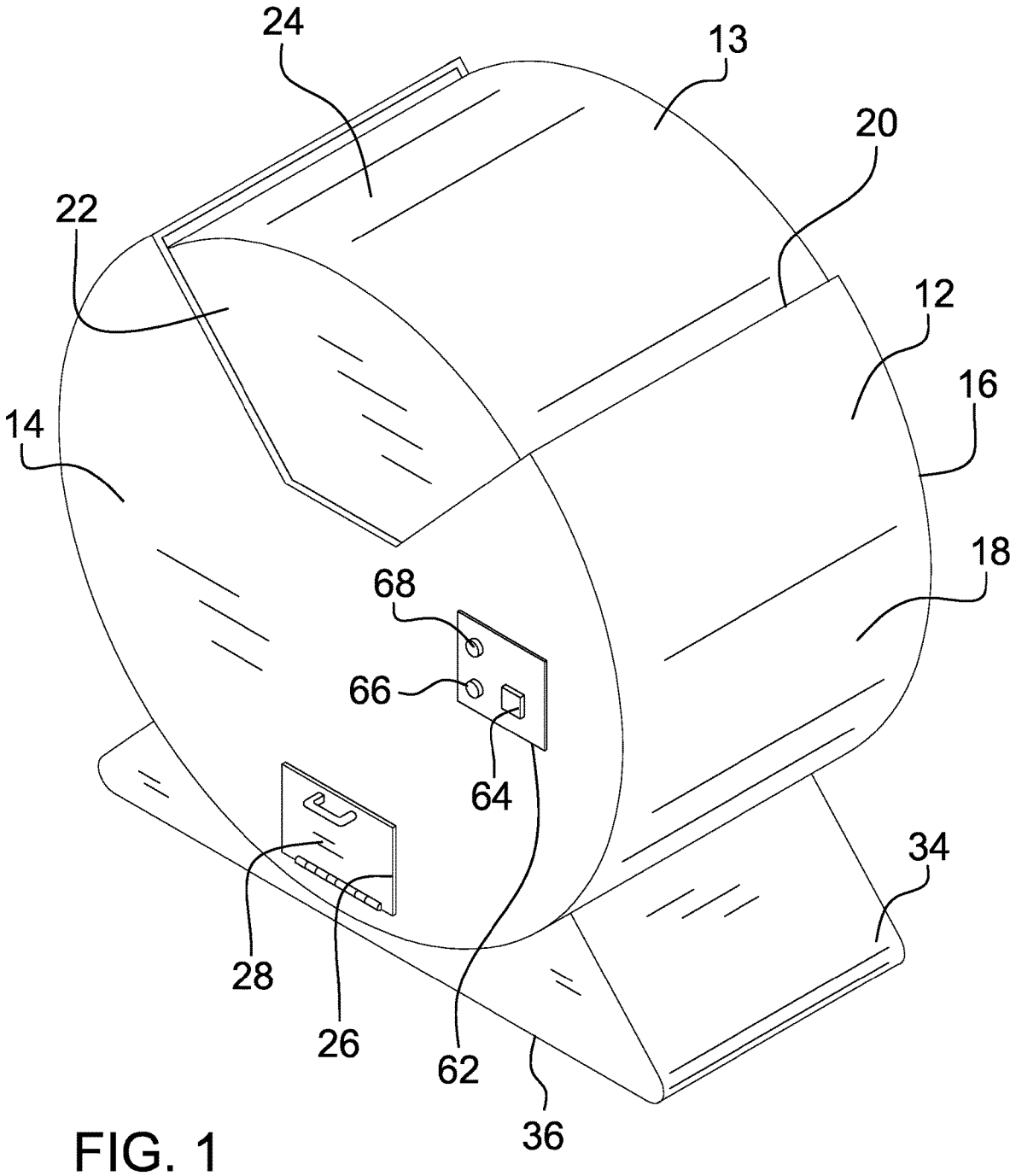
FIG. 1 is a front perspective view of a feminine product disposal assembly according to an embodiment of the disclosure.
Figure 2:
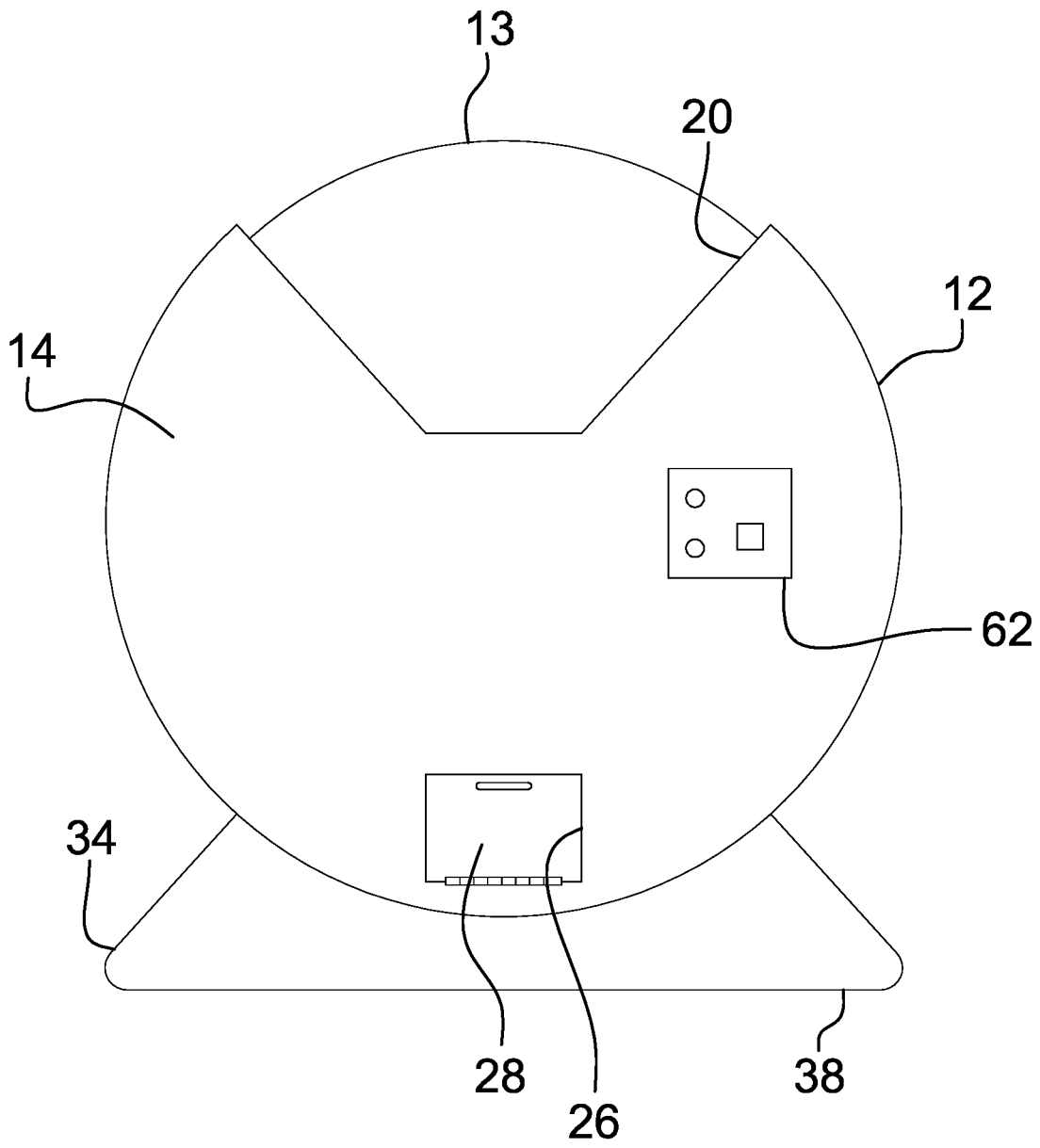
FIG. 2 is a front view of an embodiment of the disclosure.
Figure 3:
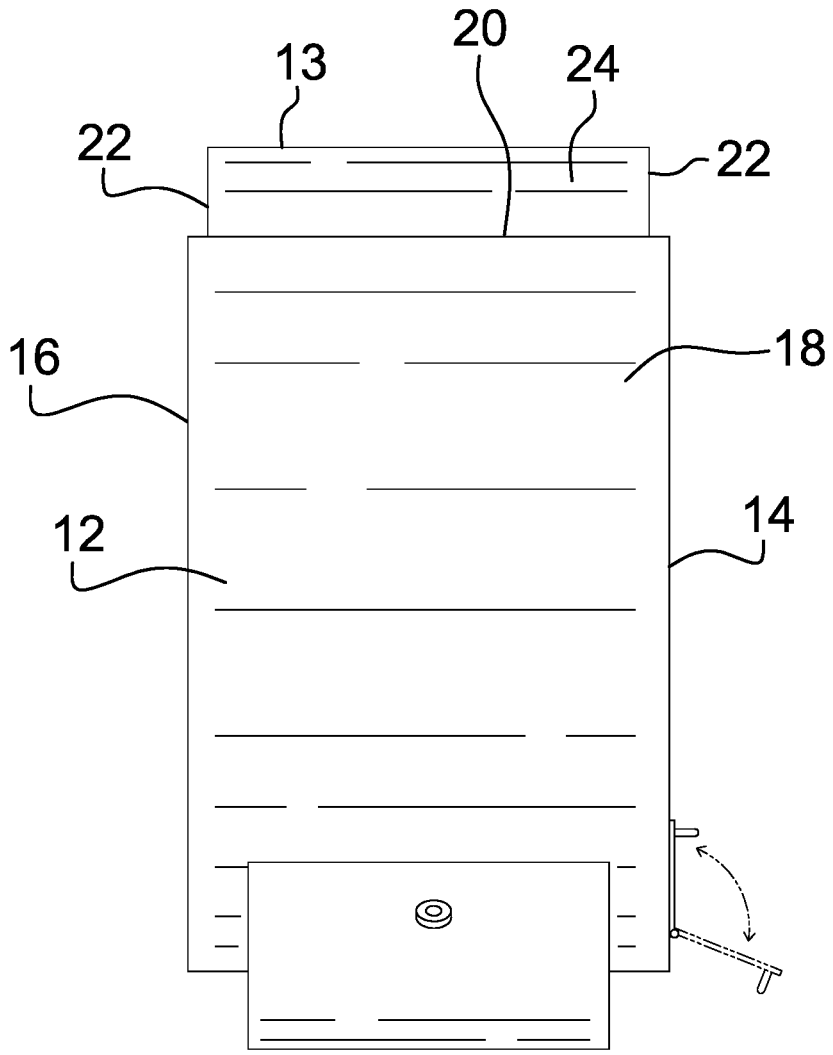
FIG. 3 is a right side view of an embodiment of the disclosure.
Figure 4:
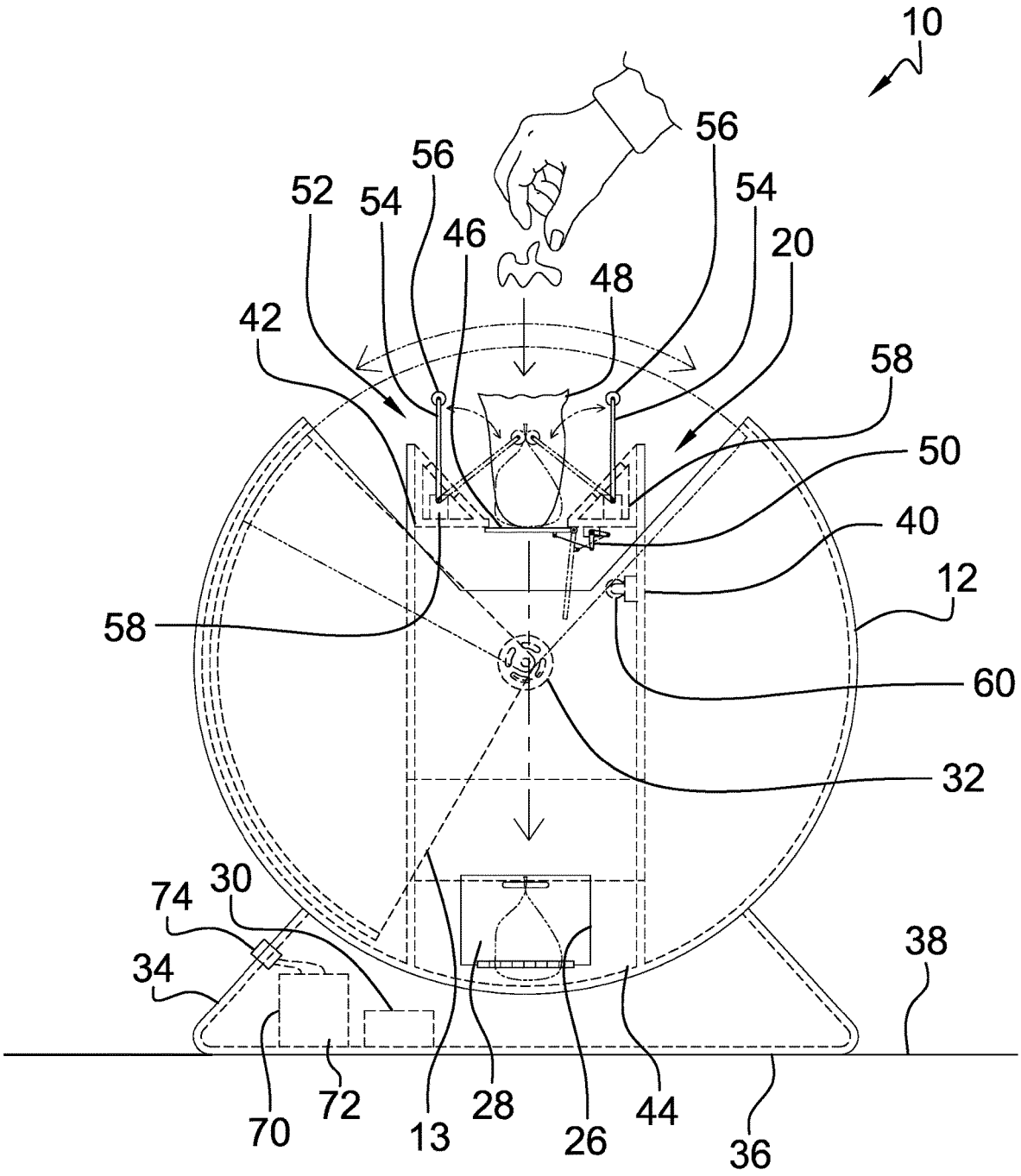
FIG. 4 is a front phantom view of an embodiment of the disclosure.
Figure 5:
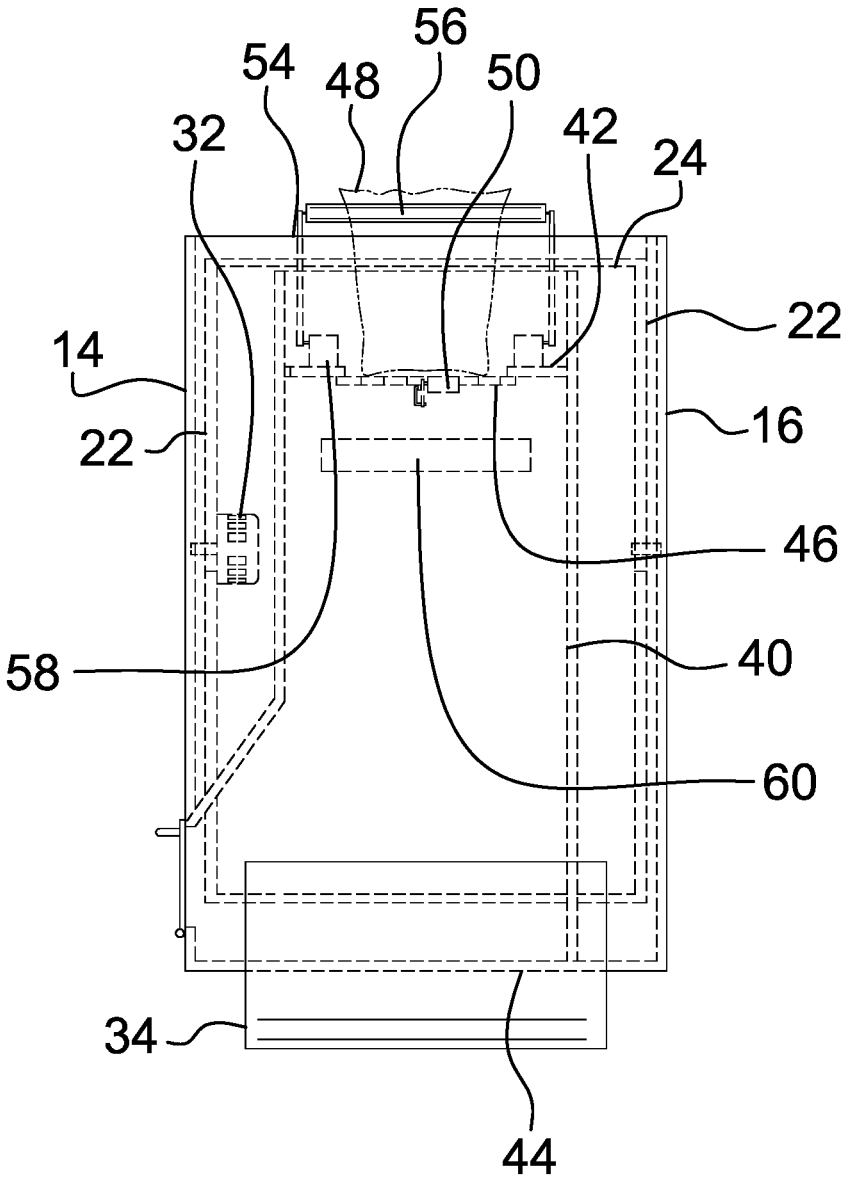
FIG. 5 is a right phantom view of an embodiment of the disclosure.

With reference now to the drawings, and in particular to FIGS. 1 through 5 thereof, a new disposal device embodying the principles and concepts of an embodiment of the disclosure and generally designated by the reference numeral 10 will be described.

As best illustrated in FIGS. 1 through 5, the feminine product disposal assembly 10 generally comprises a drum 12 that has a rotatable section 13 for opening and closing the drum 12, and the drum 12 is hollow. The drum 12 has a front wall 14, a back wall 16 and an outer wall 18 extending therebetween, and the outer wall 18 is continuously arcuate about a center point of the front wall 14 such that the drum 12 has a cylindrical shape. The outer wall 18 has an opening 20 extending into an interior of the drum 12. The rotatable section 13 has a pair of wings 22 and a top wall 24 extending between the wings 22. Each of the wings 22 is pivotally coupled to a respective one of the front wall 14 and the back wall 16 has the rotatable section 13 is positioned inside the drum 12.

The top wall 24 is co-arcuate with the outer wall 18 of the drum 12 and the top wall 24 extends across the opening 20 when the rotatable section 13 is rotated into a closed position for closing the opening 20. Conversely, the top wall 24 is displaced from the opening 20 when the rotatable section 13 is rotated into an open position. The front wall 14 of the drum 12 has an access opening 26 extending into the interior of the drum 12 and the access opening 26 is positioned adjacent to the base 34. A door 28 is hingedly coupled to the front wall 14 of the drum 12, the door 28 covers the access opening 26 when the door 28 is closed, and the door 28 exposes the access opening 26 when the door 28 is opened.

A control circuit 30 is positioned in the drum 12 and a rotating motor 32 is coupled to the rotatable section 13. The rotating motor 32 rotates in a first direction or a second direction. The rotatable section 13 is rotated into the open position when the rotating motor 32 rotates in the first direction. Additionally, the rotatable section 13 is rotated into the closed position when the rotating motor 32 rotates in the second direction. The rotating motor 32 is electrically coupled to the control circuit 30 and the rotating motor 32 may comprise an electric motor or the like.

A base 34 is attached to the outer wall 18 of the drum 12. The base 34 has a bottom side 36 and the bottom side 36 rests on a support surface 38 for supporting the drum 12 on the support surface 38. A chute 40 is positioned within the drum 12 and the chute 40 is vertically oriented in the drum 12. The chute 40 is aligned with the opening 20 in the outer wall 18 of the drum 12, and the chute 40 has a top end 42 and a bottom end 44.

A hatch 46 is positioned within the drum 12 and the garbage bag 48 sits thereon. The hatch 46 drops the garbage bag 48 downwardly in the drum 12 when the hatch 46 is opened. The hatch 46 is hingedly coupled to the top end 42 of the chute 40 and the hatch 46 closes the top end 42 of the chute 40 when the hatch 46 is in a closed position. In this way the hatch 46 can support a garbage bag 48 thereby facilitating the garbage bag 48 to receive a used feminine hygiene product. The top end 42 of the chute 40 is open when the hatch 46 is in an open position to drop the garbage bag 48 into the chute 40 for retrieval at the access opening 26 in the drum 12.

A hatch motor 50 is coupled to the chute 40 and the hatch motor 50 rotates in a first direction or a second direction. The hatch motor 50 closes the hatch 46 when the hatch motor 50 rotates in the first direction and the hatch motor 50 closes the hatch 46 when the hatch motor 50 rotates in the second direction. The hatch motor 50 is electrically coupled to the control circuit 30. Additionally, the hatch motor 50 may comprise an electric motor or the like.

A closure unit 52 is positioned in the drum 12 and the closure unit 52 is disengaged from the garbage bag 48 when the closure unit 52 is turned off. In this way the closure unit 52 facilitates the garbage bag 48 to receive the used feminine hygiene product. Moreover, the closure unit 52 closes the garbage bag 48 when the closure unit 52 is turned on. In this way the closure unit 52 encloses the used feminine product in the garbage bag 48 for disposal.

The closure unit 52 comprises a pair of arms 54 that is each pivotally coupled to the top end 42 of the chute 40. Each of the arms 54 is positionable in a first position has the arms 54 is spaced apart from each other. Each of the arms 54 is positionable in a closed position having each of the arms 54 abutting each other. In this way each of the arms 54 closes the garbage bag 48 sitting on the hatch 46.

The closure unit 52 comprises a pair of heating elements 56 and each of the heating elements 56 is coupled to a respective one of the arms 54. In this way each of the heating elements 56 contacts the garbage bag 48. Each of the heating elements 56 is turned on when the arms 54 are closed for sealing the garbage bag 48. In this way the heating elements 56 inhibit odors from escaping the garbage bag 48. Each of the heating elements 56 is electrically coupled to the control circuit 30 and each of the heating elements 56 may comprise an electric heating element or the like.

The closure unit 52 includes a pair of arm motors 58 that is each coupled to a respective one of the arms 54. Each of the arm motors 58 rotates in a first direction or a second direction. The arms 54 are urged into the first position when the arm motors 58 rotate in the first direction. Additionally, the arms 54 are urged into the second position when the arm motors 58 rotate in the second direction. Each of the arm motors 58 is electrically coupled to the control circuit 30 and each of the arm motors 58 may comprise an electric motor or the like.

An ultraviolet light emitter 60 is positioned in the drum 12 and the ultraviolet light emitter 60 is turned on when the hatch 46 is opened. The ultraviolet light emitter 60 emits ultraviolet radiation when the ultraviolet light emitter 60 is turned on. In this way the ultraviolet light emitter 60 kills bacteria in and on the garbage bag 48. The ultraviolet light emitter 60 is positioned within the chute 40. The ultraviolet light emitter 60 is positioned beneath the hatch 46 and the ultraviolet light emitter 60 is electrically coupled to the control circuit 30. The ultraviolet light emitter 60 may comprise a fluorescent ultraviolet light or the like that is capable of emitting ultraviolet radiation at an intensity sufficient to kill bacteria.

The closure unit 52 includes a control panel 62 that is coupled to the drum 12. The control panel 62 is electrically coupled to the control circuit 30 and the control panel 62 including a power button 64 for turning the control panel 62 on and off. The control panel 62 includes a rotatable section button 66 for opening and closing the rotatable section 13. Additionally, the control panel 62 includes a dispose button 68. The arms 54 are urged into the second position when the dispose button 68 is depressed and the heating elements 56 are turned on when the dispose button 68 is depressed. Additionally, the hatch 46 is opened when the dispose button 68 is depressed and the ultraviolet light emitter 60 is turned on when the dispose button 68 is depressed.

A power supply 70 is positioned in the base 34 and the power supply 70 is electrically coupled to the control circuit 30. The power supply 70 comprises at least one rechargeable battery 72 that is electrically coupled to the control circuit 30. A charge port 74 is coupled to the base 34 and the charge port 74 is electrically coupled to a power source. The charge port 74 is electrically coupled to the at least one rechargeable battery 72 for charging the at least one rechargeable battery 72.

In use, the rotatable section button 66 is depressed to open the rotatable section 13 of the drum 12 thereby facilitating the used feminine hygiene product to be dropped into the garbage bag 48 that is sitting on the hatch 46. The closure button is depressed to urge the arms 54 into the second position to close the garbage bag 48. Additionally, the heating elements 56 are turned on to seal the garbage bag 48 closed. The hatch 46 is subsequently opened to drop the sealed garbage bag 48 and the ultraviolet light is turned on to sterilize the garbage bag 48. The door 28 is opened to remove the sealed garbage bag 48 from the drum 12 for disposal.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A feminine product disposal assembly for bagging and sealing used feminine hygiene products, said assembly comprising:

a drum having a rotatable section for opening and closing said drum, said drum being hollow;

a base being attached to said outer wall of said drum, said base having a bottom side, said bottom side resting on a support surface for supporting said drum on the support surface;

a chute being positioned within said drum, said chute being vertically oriented in said drum, said chute being aligned with said opening in said outer wall of said drum;

a hatch being positioned within said drum wherein said hatch is configured to have the garbage bag sitting thereon, said hatch dropping the garbage bag downwardly in said drum when said hatch is opened;

a closure unit being positioned in said drum, said closure unit closing the garbage bag when said closure unit is turned on wherein said closure unit is configured to enclose the used feminine product in the garbage bag for disposal, said closure unit being disengaged from the garbage bag when said closure unit is turned off wherein said closure unit is configured to facilitate the garbage bag to receive the used feminine hygiene product; and a control panel being coupled to said drum, said control panel being in communication with said rotatable section of said drum, said hatch, said closure unit and an ultraviolet light, said control panel controlling operational parameters of said rotatable section, said hatch, said closure unit and said ultraviolet light.

2. The assembly according to claim 1, wherein said drum has a front wall, a back wall and an outer wall extending therebetween, said outer wall being continuously arcuate about a center point of said front wall such that said drum has a cylindrical shape, said outer wall having an opening extending into an interior of said drum, said front wall having an access opening extending into said interior of said drum, said access opening being positioned adjacent to said base.

3. The assembly according to claim 2, wherein said rotatable section has a pair of wings and a top wall extending between said wings, each of said wings being pivotally coupled to a respective one of said front wall and said back wall having said rotatable section being positioned inside said drum, said top wall being co-arcuate with said outer wall of said drum, said top wall extending across said opening when said rotatable section is rotated into a closed position for closing said opening, said top wall being displaced from said opening when said rotatable section is rotated into an open position.

4. The assembly according to claim 2, further comprising a door being hingedly coupled to said front wall of said drum, said door covering said access opening when said door is closed, said door exposing said access opening when said door is opened.

5. The assembly according to claim 2, further comprising:

a control circuit being positioned in said drum; and a rotating motor being coupled to said rotatable section, said rotating motor rotating in a first direction or a second direction, said rotatable section being rotated into said open position when said rotating motor rotates in said first direction, said rotatable section being rotated into said closed position when said rotating motor rotates in said second direction, said rotating motor being electrically coupled to said control circuit.

6. The assembly according to claim 1, wherein:

said chute has a top end and a bottom end; and said hatch is hingedly coupled to said top end of said chute, said hatch closing said top end of said chute when said hatch is in a closed position wherein said hatch is configured to support a garbage bag thereby facilitating the garbage bag to receive a used feminine hygiene product, said top end of said chute being open when said hatch is in an open position wherein said hatch is configured to drop the garbage bag into said chute for retrieval at said access opening in said drum.

7. The assembly according to claim 6, further comprising:

a control circuit being positioned in said drum; and a hatch motor being coupled to said chute, said hatch motor rotating in a first direction or a second direction, said hatch motor closing said hatch when said hatch motor rotates in said first direction, said hatch motor closing said hatch when said hatch motor rotates in said second direction, said hatch motor being electrically coupled to said control circuit.

8. The assembly according to claim 6, wherein said closure unit comprises a pair of arms, each of said arms being pivotally coupled to said top end of said chute, each of said arms being positionable in a first position having said arms being spaced apart from each other, each of said arms being positionable in a closed position having each of said arms abutting each other wherein each of said arms is configured to close the garbage bag sitting on said hatch.

9. The assembly according to claim 8, wherein said closure unit comprises a pair of heating elements, each of said heating elements being coupled to a respective one of said arms wherein each of said heating elements is configured to contact the garbage bag, each of said heating elements being turned on when said arms are closed for sealing the garbage bag wherein said heating elements are configured to inhibit odors from escaping the garbage bag, each of said heating elements being electrically coupled to said control circuit.

10. The assembly according to claim 9, wherein said closure unit includes a pair of arm motors, each of said arm motors being coupled to a respective one of said arms, each of said arm motors rotating in a first direction or a second direction, said arms being urged into said first position when said arm motors rotate in said first direction, said arms being urged into said second position when said arm motors rotate in said second direction, each of said arm motors being electrically coupled to said control circuit.

11. The assembly according to claim 1, further comprising:

a control circuit being positioned in said drum; and an ultraviolet light emitter being positioned in said drum, said ultraviolet light emitter being turned on when said hatch is opened, said ultraviolet light emitter emitting ultraviolet radiation when said ultraviolet light emitter is turned on wherein said ultraviolet light emitter is configured to kill bacteria in and on the garbage bag, said ultraviolet light emitter being positioned within said chute, said ultraviolet light emitter being positioned beneath said hatch, said ultraviolet light emitter being electrically coupled to said control circuit.

12. The assembly according to claim 9, wherein:

said assembly includes a control circuit being positioned in said drum;

said assembly includes an ultraviolet light emitter being positioned in said drum; and said control panel is electrically coupled to said control circuit, said control panel including a power button for turning said control panel on and off, said control panel including a rotatable section button for opening and closing said rotatable section, said control panel including a dispose button, said arms being urged into said second position when said dispose button is depressed, said heating element being turned on when said dispose button is depressed, said hatch being opened when said dispose button is depressed, said ultraviolet light being turned on when said dispose button is depressed.

13. The assembly according to claim 1, further comprising:

a control circuit being positioned in said drum; and a power supply being positioned in said base, said power supply being electrically coupled to said control circuit, said power supply comprising:

at least one rechargeable battery being electrically coupled to said control circuit; and a charge port being coupled to said base wherein said charge port is configured to be electrically coupled to a power source, said charge port being electrically coupled to said at least one rechargeable battery for charging said at least one rechargeable battery.

14. A feminine product disposal assembly for bagging and sealing used feminine hygiene products, said assembly comprising:

a drum having a rotatable section for opening and closing said drum, said drum being hollow said drum having a front wall, a back wall and an outer wall extending therebetween, said outer wall being continuously arcuate about a center point of said front wall such that said drum has a cylindrical shape, said outer wall having an opening extending into an interior of said drum, said rotatable section having a pair of wings and a top wall extending between said wings, each of said wings being pivotally coupled to a respective one of said front wall and said back wall having said rotatable section being positioned inside said drum, said top wall being co-arcuate with said outer wall of said drum, said top wall extending across said opening when said rotatable section is rotated into a closed position for closing said opening, said top wall being displaced from said opening when said rotatable section is rotated into an open position, said front wall having an access opening extending into said interior of said drum, said access opening being positioned adjacent to said base;

a door being hingedly coupled to said front wall of said drum, said door covering said access opening when said door is closed, said door exposing said access opening when said door is opened;

a control circuit being positioned in said drum;

a rotating motor being coupled to said rotatable section, said rotating motor rotating in a first direction or a second direction, said rotatable section being rotated into said open position when said rotating motor rotates in said first direction, said rotatable section being rotated into said closed position when said rotating motor rotates in said second direction, said rotating motor being electrically coupled to said control circuit;

a base being attached to said outer wall of said drum, said base having a bottom side, said bottom side resting on a support surface for supporting said drum on the support surface;

a chute being positioned within said drum, said chute being vertically oriented in said drum, said chute being aligned with said opening in said outer wall of said drum, said chute having a top end and a bottom end;

a hatch being positioned within said drum wherein said hatch is configured to have the garbage bag sitting thereon, said hatch dropping the garbage bag downwardly in said drum when said hatch is opened, said hatch being hingedly coupled to said top end of said chute, said hatch closing said top end of said chute when said hatch is in a closed position wherein said hatch is configured to support a garbage bag thereby facilitating the garbage bag to receive a used feminine hygiene product, said top end of said chute being open when said hatch is in an open position wherein said hatch is configured to drop the garbage bag into said chute for retrieval at said access opening in said drum;

a hatch motor being coupled to said chute, said hatch motor rotating in a first direction or a second direction, said hatch motor closing said hatch when said hatch motor rotates in said first direction, said hatch motor closing said hatch when said hatch motor rotates in said second direction, said hatch motor being electrically coupled to said control circuit; and a closure unit being positioned in said drum, said closure unit closing the garbage bag when said closure unit is turned on wherein said closure unit is configured to enclose the used feminine product in the garbage bag for disposal, said closure unit being disengaged from the garbage bag when said closure unit is turned off wherein said closure unit is configured to facilitate the garbage bag to receive the used feminine hygiene product, said closure unit comprising:

a pair of arms, each of said arms being pivotally coupled to said top end of said chute, each of said arms being positionable in a first position having said arms being spaced apart from each other, each of said arms being positionable in a closed position having each of said arms abutting each other wherein each of said arms is configured to close the garbage bag sitting on said hatch;

a pair of heating elements, each of said heating elements being coupled to a respective one of said arms wherein each of said heating elements is configured to contact the garbage bag, each of said heating elements being turned on when said arms are closed for sealing the garbage bag wherein said heating elements are configured to inhibit odors from escaping the garbage bag, each of said heating elements being electrically coupled to said control circuit; and a pair of arm motors, each of said arm motors being coupled to a respective one of said arms, each of said arm motors rotating in a first direction or a second direction, said arms being urged into said first position when said arm motors rotate in said first direction, said arms being urged into said second position when said arm motors rotate in said second direction, each of said arm motors being electrically coupled to said control circuit;

an ultraviolet light emitter being positioned in said drum, said ultraviolet light emitter being turned on when said hatch is opened, said ultraviolet light emitter emitting ultraviolet radiation when said ultraviolet light emitter is turned on wherein said ultraviolet light emitter is configured to kill bacteria in and on the garbage bag, said ultraviolet light emitter being positioned within said chute, said ultraviolet light emitter being positioned beneath said hatch, said ultraviolet light emitter being electrically coupled to said control circuit;

a control panel being coupled to said drum, said control panel being in communication with said rotatable section of said drum, said hatch, said closure unit and said ultraviolet light, said control panel controlling operational parameters of said rotatable section, said hatch, said closure unit and said ultraviolet light, said control panel being electrically coupled to said control circuit, said control panel including a power button for turning said control panel on and off, said control panel including a rotatable section button for opening and closing said rotatable section, said control panel including a dispose button, said arms being urged into said second position when said dispose button is depressed, said heating element being turned on when said dispose button is depressed, said hatch being opened when said dispose button is depressed, said ultraviolet light being turned on when said dispose button is depressed; and a power supply being positioned in said base, said power supply being electrically coupled to said control circuit, said power supply comprising:

at least one rechargeable battery being electrically coupled to said control circuit; and a charge port being coupled to said base wherein said charge port is configured to be electrically coupled to a power source, said charge port being electrically coupled to said at least one rechargeable battery for charging said at least one rechargeable battery.

* * * * *